United States Patent [19]

Kamino

[11] 4,024,488

[45] May 17, 1977

[54] SELF-RESTORING TYPE CURRENT LIMITING DEVICE

[75] Inventor: Toshihide Kamino, Kishiwada, Japan

[73] Assignee: Terasaki Denki Sangyo Kabushiki Kaisha, Osaka, Japan

[22] Filed: Dec. 17, 1975

[21] Appl. No.: 641,586

[52] U.S. Cl. ..... 337/114; 337/119

[51] Int. Cl.[2] ..... H01H 87/00

[58] Field of Search ..... 335/114, 115, 116, 117, 335/118, 119, 120, 121, 122, 306, 326, 331

[56] References Cited

UNITED STATES PATENTS

| | | | |
|---|---|---|---|
| 3,611,041 | 10/1971 | Ito et al. | 337/114 |
| 3,644,860 | 2/1972 | Yamagata et al. | 337/118 |
| 3,735,309 | 5/1973 | Hurtle | 337/121 |
| 3,747,040 | 7/1973 | Inoue | 337/119 |
| 3,753,190 | 8/1973 | Ito et al. | 337/118 |
| 3,886,511 | 5/1975 | Miyamoto et al. | 337/119 |
| 3,886,511 | 5/1975 | Miyamoto et al. | 337/121 |
| 3,902,150 | 8/1975 | Wada et al. | 337/121 |
| 3,909,763 | 9/1975 | Soeno et al. | 337/114 |

*Primary Examiner*—Harold Broome
*Attorney, Agent, or Firm*—Wenderoth, Lind & Ponack

[57] ABSTRACT

One electrode is rigidly fitted into a hollow metallic cylinder and the other electrode is coaxially fixed within the cylinder through a cylindrical insulation. An insulating disc is opposite to the cylindrical insulation to form them an annular arrow gap between them. The gap is filled with a self-restoring type current limiting material to normally form a current passageway between both electrodes. The current limiting material is caused to be first evaporated in a narrower portion of the gap in response to a flow of overcurrent through it.

5 Claims, 10 Drawing Figures

SELF-RESTORING TYPE CURRENT LIMITING DEVICE

BACKGROUND OF THE INVENTION

This invention relates to improvements in a self-restoring type current limiting device.

The self-restoring type of current limiting devices includes an amount of a self-restoring type current limiting material put in the form of a solid electrically conductive at room temperature and responsive to a flow of overcurrent therethrough to be evaporated to limit the overcurrent. After the current has been limited, the evaporated material is rapidly self-restored to its original good electrically conductive state.

In current limiting devices of the type referred to, the current limiting operation thereof is determined by the cross sectional area of the narrowest portion of the current passageway where the current limiting material is first evaporated. The performance of current limitation can be improved by making a cross sectional area of that portion of the current passageway where the current limiting material is first evaporated as small as possible. This measure however, results in a decrease in magnitude of a current normally flowing through the current passageway. Therefore current limiting devices of the type referred to are required to include the current passageway having its minimum cross sectional area as small as possible while a current normally flowing through the current passageway is high in magnitude.

SUMMARY OF THE INVENTION

It is an object of the present invention to provide a new and improved current limiting device of the self-restoring type excellent in performance of current limitation and increased in magnitude of a current normally flowing therethrough as compared with the prior art practice.

The present invention accomplishes this object by the provision of a self-restoring type current limiting device comprising, in combination, a first electrode, a second electrode opposite to the first electrode an electrically insulating plate and an electrical insulation with a through hole disposed in opposite relationship between the first and second electrodes to form a gap between the insulating plate and the insulation, an amount of self-restoring current limiting material filling the gap to form a current passageway between the first and second electrodes, and an annular narrow gap portion disposed in one part of the current passageway, the self-restoring type current limiting material being responsive to an overcurrent flowing therethrough to be first evaporated in that portion of the annular gap portion radially outwardly running.

Preferably the annular narrow gap portion has a cross sectional area for current condition decreased from its radially inner periphery to its radially outer periphery.

BRIEF DESCRIPTION OF THE DRAWINGS

The present invention will become more readily apparent from the following detailed description taken in conjunction with the accompanying drawings.

DESCRIPTION OF THE PREFERRED EMBODIMENTS

Figure 1:
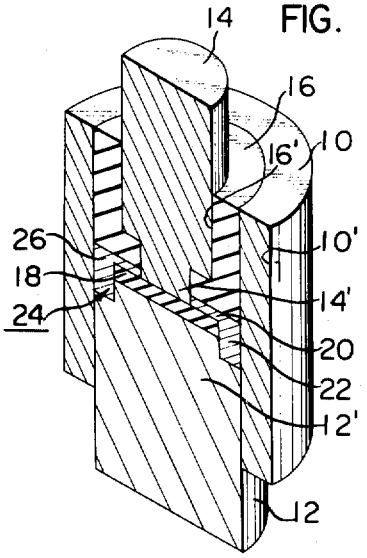
FIG. 1 is a perspective view of one half of a self-restoring type current limiting device constructed in accordance with the principles of the present invention and cut along the central longitudinal plane thereof.

Referring now to the drawings and FIG. 1 in particular, there is illustrated a self-restoring type current limiting device constructed in accordance with the principles of the present invention. The arrangement illustrated comprises a metallic casing 10 in the form of a hollow cylinder and a pair of first and second cylindrical metallic electrodes 12 and 14 respectively disposed in opposite spaced relationship within the casing 10 and extended from the both ends of the latter respectively. The first electrode 12 is greater in diameter than the second electrode 14 and provided on the inner end surface opposite to the second electrode 14 with a central protrusion greater in diameter than a corresponding protrusion disposed on the second electrode 14. The first electrode 12 is rigidly fitted into the cylindrical interior of the casing 10 while the second electrode 14 is coaxially disposed within the casing 10 and fixed at a predetermined axial position within the latter by means of a hollow electrical insulation 16 of any suitable ceramic material complementary in configuration to an annular stepped space formed between the second electrode 14 and the casing 10 and disposed in that space. The electrical insulation 16 has one end surface, in this case, the upper end surface as viewed in FIG. 1 substantially flush with the adjacent end surface of the casing 10 and the other or lower end surface from which the projection 14 of the second electrode 14 projects a predetermined length of from about 0.1 to 0.5 mm.

Figure 2:
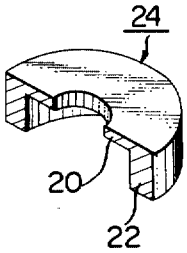
FIG. 2 is a perspective view of one half of the current passageway shown in FIG. 1.

Within the casing 10 the protrusions 12' and 14' have sandwiched therebetween an electrically insulating disc 18 substantially coextensive with the end surface of the protrusion 12'. The insulating disc 18 may be of the same material as the cylindrical insulation 16 to form an annular gap 20 about the extremity of the second electrode 14 with the insulation 16. The annular gap 20 has its axial dimension or its width as determined by the length of the exposed protrusion 14' portion, in this case, of from 0.1 to 0.5 mm. Thus the annular gap 20 has the axial dimension very narrower than the radial dimension and communicates at the radially outer periphery with an annular, axially extending gap 22 defined by the insulation 16, the casing 10, the insulating disc 18 and the first electrode 12. The radial gap 20 connected to the axial gap 22, as best shown in FIG. 2, forms a toroidal space generally designated by the reference numeral 24 and having an inverted L-shaped cross section including a radially inwardly directed leg very thinner than the axial leg of the "L". That toroidal space may be called hereinafter a current passageway, which is, in turn, filled with an amount of any suitable, self-restoring type current limiting material 26 such as sodium (Na), potassium (K) or a sodium-potassium alloy (NaK).

If any overcurrent occurs in an associated circuit (not shown) then it flows, for example, from the second electrode 14 to the first electrode 12 through the current passageway 24 formed of the current limiting material 26. This causes the generation of a Joule's heat in the current limiting material 26 itself until it is evaporated to limit the overcurrent It is to be noted that the annular narrow gap 20 is formed to radially extend between the insulation 16 and the insulating disc 18 so as to first evaporate that portion of the current limiting material 26 located in the radial narrow gap 20. This measure is very advantageous in that a heat dissipation surface for that portion of the current limiting material 26 filling the radial narrow gap 20 or those surfaces of the opposite insulation and insulating disc 16 and 18 respectively contacted by the said portion of the current limiting material 26 is distinctively large in area as compared with conventional self-restoring type current limiting devices including the hollow cylindrical insulation disposed coaxially with the casing of circular cross section and filled with the similar current limiting material. Therefore the present invention is good in heat dissipation and can increase in magnitude of a current permitted normally to flow therethrough for the small cross sectional area of that portion of the current limiting material first evaporated in response to an overcurrent flowing therethrough.

Also conventional self-restoring type current limiting devices have generally included the hollow cylinder formed of a ceramic material high in pressure resistance and filled with an amount of a self-restoring type current limiting material. In such devices the evaporation of the current limiting material has resulted in the imposition of a tensile stress upon the ceramic cylinder. Therefore the ceramic cylinder has been required to be carefully formed into a pressure resisting structure.

In the present invention, however, that portion of the current limiting material first evaporated is confined by the annular thin disc-shaped gap 20 formed between the annular surfaces of the insulation 16 and the insulating disc 18. In this measure, the evaporation of the current limiting material permits only a compressive force to be applied to both the insulation 16 and the insulating disc 18. Thus the current limiting material 26 can be charged into a space surrounded by the casing 10 formed of a metallic material high in tenacity. This is advantageous in view of the pressure resisting structure.

Figure 3:
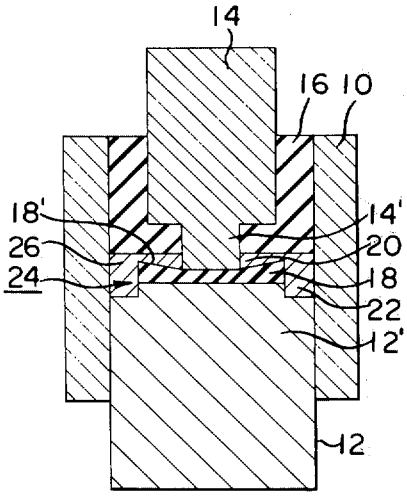
FIG. 3 is a view similar to FIG. 1 but illustrating a modification of the present invention.
Figure 4:
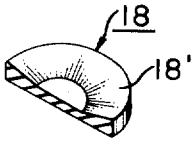
FIG. 4 is a perspective view of one half of the electrically insulating disc shown in FIG. 3.
Figure 5:
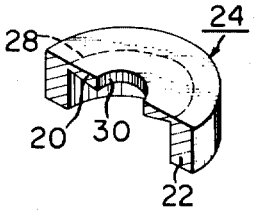
FIG. 5 is a perspective view of one half of the current passageway shown in FIG. 3.

In FIG. 3 wherein like reference numerals designate the components identical or corresponding to those shown in FIG. 1, there is illustrated a modification of the present invention. The arrangement illustrated is different from that shown in FIG. 1 only in the configuration of the electrically insulating disc. In FIG. 3 the electrically insulating disc 18 is provided on that surface thereof facing the second electrode 14 with a disc-shaped recess having a central flat surface portion (see FIG. 4) on which the end surface of the protrusion 14' on the second electrode 14 is rest. Therefore the radial gap 20 is tapered toward the radially outer end and forms a current passageway 24 as shown in FIG. 5. As shown in FIG. 5, the annular narrow gap 20 radially extends so as to render its radially outer periphery 28 smaller in cross sectional area for current conduction than its radially inner periphery 30 contacted by the exposed portion of the protrusion 14' of the second electrode 14.

Figure 6:
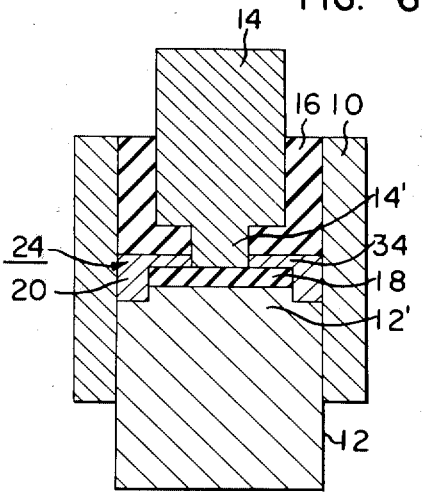
FIG. 6 is a view similar to FIG. 1 but illustrating another modification of the present invention.
Figure 7:
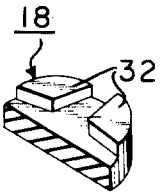
FIGS. 7 and 8 are views similar to FIGS. 4 and 5 respectively but illustrating the arrangement shown in FIG. 6.
Figure 8:
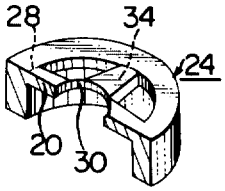

In another modification of the present invention shown in FIG. 6 wherein like reference numerals designate the components identical or corresponding to those shown in FIG. 1, the electrically insulating disc 18 is provided on that surface thereof facing the second electrode 14 with a plurality, in this case, four of flat ridges 32 in the form of sectors located at substantially equal angular intervals with vertex thereof adapted to abut against the periphery of the exposed portion of the second electrode 14. When assembled, the insulating disc 18 has the flat ridges 32 contacted by the end surface of the second electrode 14 to form a plurality, in the example illustrated, four of radial slits 34 formed of spaces between the adjacent ridges 32 as best shown in FIG. 8. As shown in FIG. 8, the radial gap 20 thus formed between the insulation 16 and the insulating disc 18 consists of four radial slits 34 radially outwardly tapered. Each slit 34 has its radially outer periphery 28 smaller in cross sectional area for current conduction than its radially inner periphery.

Figure 9:
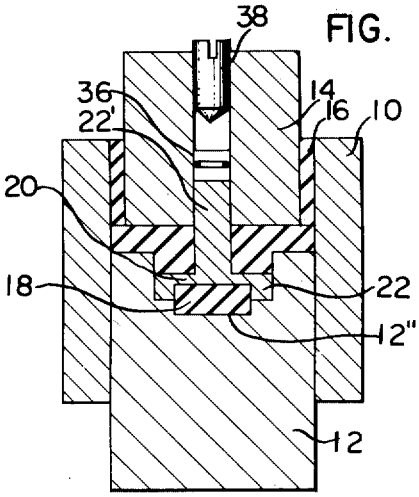
FIG. 9 is a view similar to FIG. 1 but illustrating a further modification of the present invention.

In a further modification of the present invention illustrated in FIG. 9 wherein like reference numerals designate the components identical or corresponding to those shown in FIG. 1, the first electrode 12 is provided on the central portion of the inner end surface facing the second electrode 14 with a cylindrical stepped recess. The recess has the electrically insulating disc 18 snugly fitted into the lower portion 12'' thereof to somewhat project into the upper portion of the recess. Then the recess is closed with a protrusion on the electrical insulation 16 rigidly fitted in the casing 10 to abut against the first electrode 12 while forming the radial narrow gap 20 between the protrusion on the insulation 16 and the insulating disc 18 and the annular, axially extending gap 22 defined by the insulation 16 protrusion, the first electrode 12 and the insulating disc 18. The electrical insulation 16 includes a central hole extending therethrough to open into the central portion of the radial gap 20.

Figure 10:
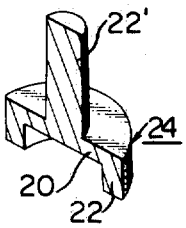
FIG. 10 is a perspective view of one half of the current passageway shown in FIG. 9.

The second electrode 14 is disposed upon the electrical insulation 16 and fixed in place in the casing 10 through an annular electrical insulation 16' disposed therebetween. The insulation 16' may be of the same material as the insulation 16. The second electrode 14 includes a central through hole identical in diameter to and communicating with that in the insulation 16. The central hole in the second electrode 14 includes therein a pressure relief device having a pressure relief barrier 36 and hermetically closed with a sealing plug 38. The remaining portion 22' of the electrode 14 hole and the gaps 20 and 22 are filled with an amount of a self-restoring type current limiting material to form the current passageway 24 such as shown in FIG. 10. As shown in FIG. 10, the radial gap 20 is narrower than the remaining portion of the current passageway.

As in the arrangements as previously described, the self-restoring type current limiting material is first evaporated in the narrow gap 20 in response to a flow of overcurrent therethrough to limit the current. The pressure relief barrier 36 is responsive to an increase in pressure in the gaps 22', 20 and 22 due to the evaporation of the current limiting material to be moved toward the closed end of the electrode 14' hole thereby to prevent an excessive increase in pressure within the while gap. After the current limiting material has been returned back to its original state, the barrier 36 also occupies its original position illustrated in FIG. 9.

In the arrangements as shown in FIGS. 3 and 6 the current passageway 24 includes the radial portion 20 having the radially outer periphery 28 smaller in cross sectional area for current conduction than the radially inner periphery 30 as above described while the current passageway 24 as shown in each of FIGS. 1 and 9 includes the radial portion 20 having the radially outer periphery 28 substantially equal in cross sectional area for current conduction to the radially inner periphery 30. Therefore the arrangements as shown in FIGS. 3 and 6 are more advantageous over the arrangements of FIGS. 1 and 9 in that portion of the current limiting material evaporated become more uniform in temperature distribution to further improve the evaporation characteristic of the current limiting material while additionally increasing a magnitude of a current normally flowing therethrough.

Thus it is seen that the present invention provides a self-restoring type current limiting device comprising a pair of opposite, spaced electrodes, an electrical insulation disposed in abutting relationship with one of the electrode, an electrically insulating plate facing the electrical insulation, a gap formed between the insulation and the insulating disc, and an amount of self-restoring type current limiting material filling the gap to form between both electrodes a current passageway large in area of heat dissipation whereby the current limiting material is first evaporated in the radially directed narrow portion of the gap in response to an overcurrent flowing through the current passageway. Therefore the present device is advantageous in that the ability to limit currents is improved and a current normally flowing through the device can increased in magnitude. Further by rendering the radially outer periphery of the annular narrow gap smaller in cross sectional area for current conduction than the radially inner periphery thereof, the current passageway become uniform in temperature distribution to further improve the evaporation characteristic of the current limiting material while a current normally flowing through the device additionally increases in magnitude.

While the present invention has been illustrated and described in conjunction with a few preferred embodiments thereof it is to be understood that numerous changes and modifications may be resorted to without departing from the spirit and scope of the present invention. For example, the current passageway may be formed in any desired configuration different from that described herein. Also in order to decrease the cross sectional area for current conduction on the radially outer periphery of the radially directed narrow gap, the latter may be given any desired configuration other than the configurations illustrated.

What is claimed is:

1. A self-restoring type current limiting device comprising, in combination, a first electrode, a second electrode opposite to said first electrode, an electrically insulating plate and an electrical insulation with a through hole disposed in opposite relationship between said first and second electrodes to form a gap between said insulating disc and said insulation, an amount of self-restoring type current limiting material filling said gap to form a current passageway between said first and second electrodes, and an annular narrow gap portion disposed in one part of said current passageway, said self-restoring type current limiting material being responsive to an overcurrent flowing therethrough to be first evaporated in that portion of said annular narrow gap portion radially outwardly running.

2. A self-restoring type current limiting deice as claimed in claim 1 wherein said radial narrow gap portion has a cross sectional area for current conduction decreased from its radially inner periphery to its radially outer periphery.

3. A self-restoring type current limiting device as claimed in claim 1 wherein said radial narrow gap portion includes a plurality of tapered slits disposed at substantially equal angular intervals.

4. A self-restoring type current limiting device comprising, in combination, a hollow cylindrical metallic casing, a first cylindrical electrode rigidly fitted into said cylindrical casing, a second cylindrical electrode coaxially disposed within said cylindrical casing to oppose to said first electrode, a hollow cylindrical electrical insulation disposed between said cylindrical casing and said second cylindrical electrode to maintain said second electrode at a predetermined axial position within said casing, that end portion of said second electrode opposite to said first electrode projecting beyond the adjacent end of said electrical insulation by a predetermined small length, an electrically insulating disc sandwiched between said first and second electrodes to form an annular gap between said electrical insulation and said first electrode within said casing, said annular gap including a radial narrow gap portion formed between said insulating disc and the opposite portion of said electric insulation about the projecting end portion of said second electrode, and an amount of a self-restoring type current limiting material filling said annular gap to form a current pasageway between said first and second electrodes, said self-restoring type current limiting material being responsive to an overcurrent flowing therethrough to be first evaporated in said radial narrow gap portion.

5. A self-restoring type current limiting device comprising, in combination, a hollow cylindrical casing, a first cylindrical electrode rigidly fitted into said cylindrical casing, and including a central recess disposed in that end portion thereof located in said casing, a second cylindrical electrode disposed in electrically insulating relationship within said cylindrical casing to oppose to said first electrode, an electrically insulating disc disposed in said central recess on said first electrode, an electrical insulation sandwiched between said first and second electrodes and including a protrusion facing said insulating disc to form radial narrow gap therebetween, said second electrode and said electrical insulation being provided with a central hole extending therethrough to have one end opening into said radial narrow gap and the other end hermetically closed, pressure relief means disposed within that portion of said central hole disposed within said second electrode, and an amount of a self-restoring type current limiting material filling both said radial narrow gap and that portion of said central hole located between said pressure relief means and the one end of said central hole to form a current passageway between said first and second electrode, said radial narrow gap being dimensioned such that said self-restoring type current limiting material is first evaporated in said radial narrow gap in response to an overcurrent flowing therethrough.

* * * * *